US006854681B2

(12) United States Patent
Kish

(10) Patent No.: US 6,854,681 B2
(45) Date of Patent: Feb. 15, 2005

(54) RETRACTABLE PENCIL/PEN/STYLUS HOLDER

(76) Inventor: Louis A. Kish, 10961 Arroyo Ave., Santa Ana, CA (US) 92705

( * ) Notice: Subject to any disclaimer, the term of this patent is extended or adjusted under 35 U.S.C. 154(b) by 0 days.

(21) Appl. No.: 10/632,429

(22) Filed: Jul. 31, 2003

(65) Prior Publication Data

US 2004/0026556 A1 Feb. 12, 2004

Related U.S. Application Data

(60) Provisional application No. 60/402,412, filed on Aug. 9, 2002, and provisional application No. 60/454,008, filed on Mar. 13, 2003.

(51) Int. Cl.[7] ..... B65H 75/48; B43K 23/02; A45F 5/02

(52) U.S. Cl. ..... 242/380; 224/162; 224/251; 401/131

(58) Field of Search ..... 242/380, 402; 401/131; 224/162, 251

(56) References Cited

U.S. PATENT DOCUMENTS

| | | | | | |
|---|---|---|---|---|---|
| 245,257 | A | | 8/1881 | Wright | 242/379 |
| 264,593 | A | | 9/1882 | Wright | 242/385.1 |
| 706,697 | A | | 8/1902 | Sims | 242/379.2 |
| 1,506,207 | A | * | 8/1924 | Wahl | 401/131 |
| 1,576,965 | A | | 3/1926 | Giese | 242/379.2 |
| 1,577,272 | A | | 3/1926 | Treadaway | 242/379.2 |
| 1,799,688 | A | | 4/1931 | Jaffe | 242/379.2 |
| 4,884,730 | A | | 12/1989 | Carpenter | 224/162 |
| 5,358,348 | A | | 10/1994 | Kennedy | 401/131 |
| 5,971,238 | A | | 10/1999 | Malvasi et al. | 224/148.6 |
| 6,073,875 | A | * | 6/2000 | Paugh | 242/380 |
| 6,318,921 | B1 | * | 11/2001 | Craine | 401/131 |
| 6,382,481 | B1 | | 5/2002 | McIlmoil | 224/162 |
| 6,499,899 | B2 | | 12/2002 | Sawyer | 401/131 |

* cited by examiner

*Primary Examiner*—John M. Jillions
(74) *Attorney, Agent, or Firm*—Cislo & Thomas, LLP

(57) ABSTRACT

Exemplary embodiments are directed to a retractable instrument holder. More specifically, the instrument holder is composed of an adapter coupled to a retractable reel. The adapter includes a main cavity that has an inner bore of varying diameters. Accordingly, the adapter is capable of retaining instruments of varying sizes as well as those instruments having a variety of shapes.

19 Claims, 3 Drawing Sheets

RETRACTABLE PENCIL/PEN/STYLUS HOLDER

CROSS-REFERENCE TO RELATED APPLICATIONS

This application claims the benefit of U.S. Provisional Application No. 60/402,412 filed on Aug. 9, 2002 and U.S. Provisional Application No. 60/454,008 filed on Mar. 13, 2003. The content of these Provisional Applications are hereby incorporated by reference.

BACKGROUND

Many people use writing, marking or pointing instruments (hereinafter referred to generally as "instruments") in their trade, hobby or leisure times. These instruments may be in the shape of a carpenter's pencil, felt tip marker, regular pencil, golf pencil, "clicker" or stick pen, stylus or a pointer. In many situations the users of these instruments are moving from place to place as they perform their task. One of the more frustrating and time wasting aspects of these tasks is when they drop or misplace their instrument. Accordingly, there is a need to provide a device that retains an instrument without sacrificing the accessibility of the instrument.

SUMMARY

Exemplary embodiments disclosed herein are directed to a retractable device for retaining writing, marking or pointing instruments at an accessible location for an individual. Generally, the retractable device is composed of a retractable reel coupled to a flexible member that is sized to engage an instrument. The flexible member may be selectively extended and retracted to provide better access to the instrument. The flexible member includes a first bore and a second bore. The first bore is sized to receive a connector from the retractable reel. The second bore has a varying inner diameter thereby allowing instruments of various sizes to be held within the flexible member.

According to various exemplary embodiments, the retractable device may include fasteners to reversibly couple the retractable device to the user or other readily accessible surfaces. For example, one exemplary embodiment of the retractable device utilizes a clip that allows the device to be coupled to the belt or pants of the user. In another exemplary embodiment, the device includes a shaft that extends from the device that may be placed within a pencil holder or the like.

DETAILED DESCRIPTION

The detailed description set forth below in connection with the appended drawings is intended as a description of exemplary embodiments and is not intended to represent the only forms in which the exemplary embodiments may be constructed and/or utilized.

Figure 1:
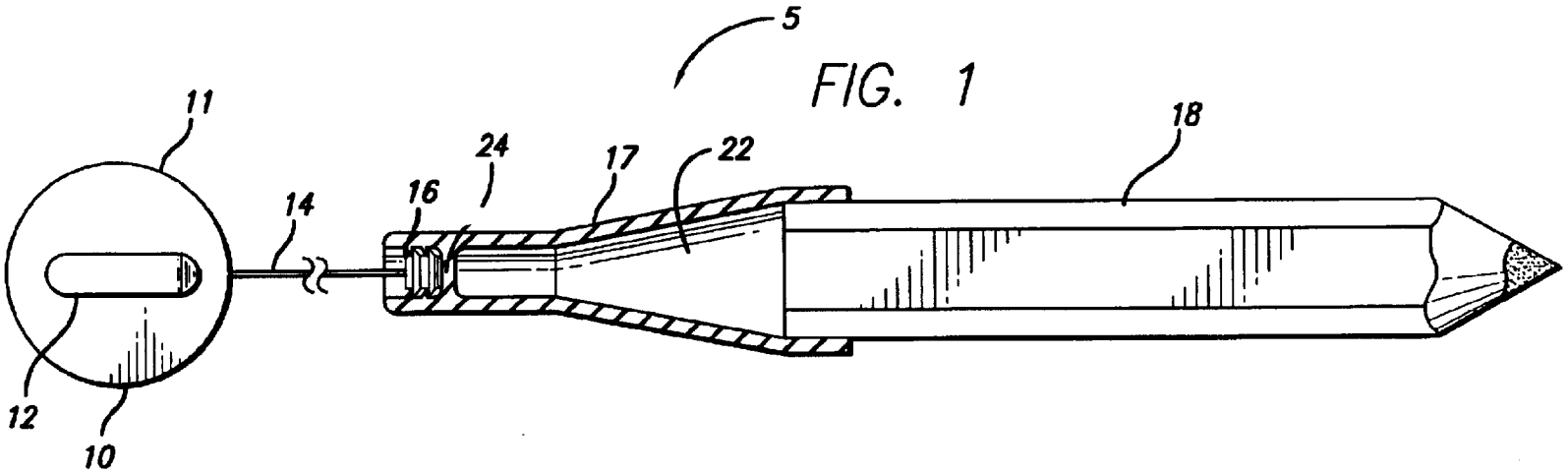
FIG. 1 is a cross-sectional view of an exemplary embodiment engaging a large diameter instrument.

Turning to the drawings, FIG. 1 is directed to one exemplary embodiment of a retractable instrument holder 5. As shown in FIG. 1, the retractable instrument holder 5 is composed of a retractor 11 coupled to a flexible retaining member 17. In the exemplary embodiment as shown in FIG. 1, the retractor 11 is a conventional type retractor having a housing 10 and a fastening means 12 for attaching the retractor 11 to an individual's clothing, or a clipboard, an ear sun visor, or a pencil holder. The fastening means 12 may be a belt clip or a bulldog clip, clamps such as alligator clamps, hooks or other coupling structures known or developed in the art. The retractor 11 has an internal retractable reel connected to a cable 14 that can be extended approximately 2 to approximately 3 feet from the reel. As those skilled in the art will appreciate, the length of the cable 14 may be varied to accommodate various intended uses.

Figure 2:
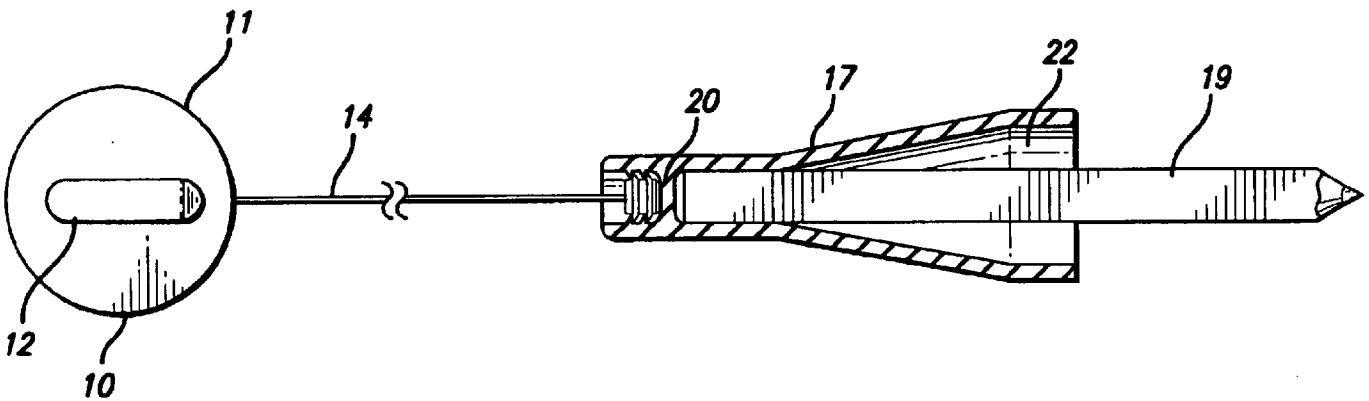
FIG. 2 is a cross-sectional view of an exemplary embodiment engaging a small diameter instrument.
Figure 3:
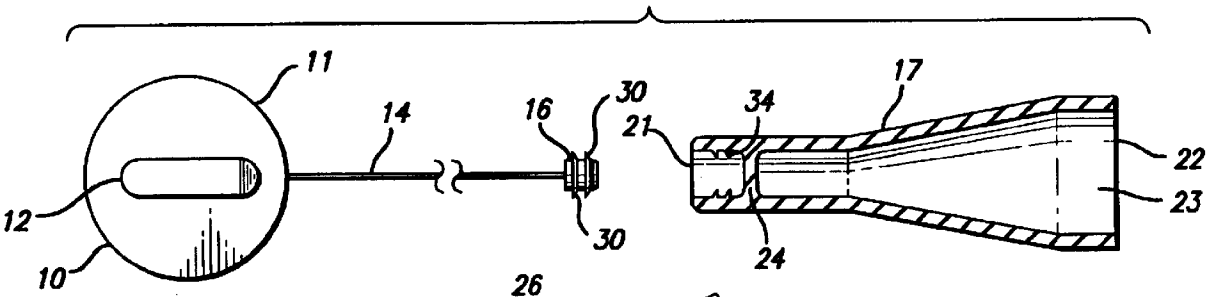
FIG. 3 is an exploded side cross-sectional view of an exemplary embodiment.
Figure 5:
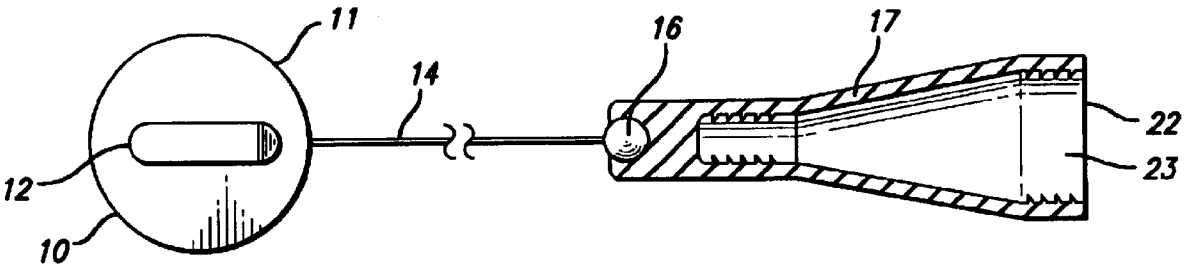
FIG. 5 is a cross-sectional side view of another exemplary embodiment.

As shown in FIG. 1, a plug 16 is attached to one end of the cable 14. According to one exemplary embodiment, the plug 16 may be a generally cylindrical structure having annular ridges 30 provided about the outer diameter as shown in FIGS. 1–3. In another exemplary embodiment, the plug 16 may not include the annular ridges on the outer diameter. In yet another exemplary embodiment, the plug 16 may be a generally spherical structure as shown in FIG. 5. In another exemplary embodiment, the plug 16 may be provided with threads 32 on the outer diameter. As those skilled in the art will appreciate, the plug 16 may have a plurality of shapes and be made from a plurality of materials such as, but not limited to, plastic, metal, alloys, ceramics, or the like.

As shown in FIG. 1, the plug 16 is inserted into a bore 21 that is positioned at one end of the flexible retaining member 17. According to one exemplary embodiment, the plug 16 is held by friction fit against the inner walls of the bore 21. To achieve a friction fit, the diameter of the plug 16 may be slightly larger than the diameter of the bore 21. In other exemplary embodiment, the plug 16 having annular ridges 30 may engage corresponding annular ridges 34 provided on the bore 21 to retain the plug 16 in the bore 21. In yet another exemplary embodiment, the threads 32 provided on the plug 16 may engage and mate with corresponding threads 36 provided on the walls of the bore 21. In another exemplary embodiment, the plug 16 may be snap-fitted into the bore 21 as shown in FIG. 5.

Figure 6:
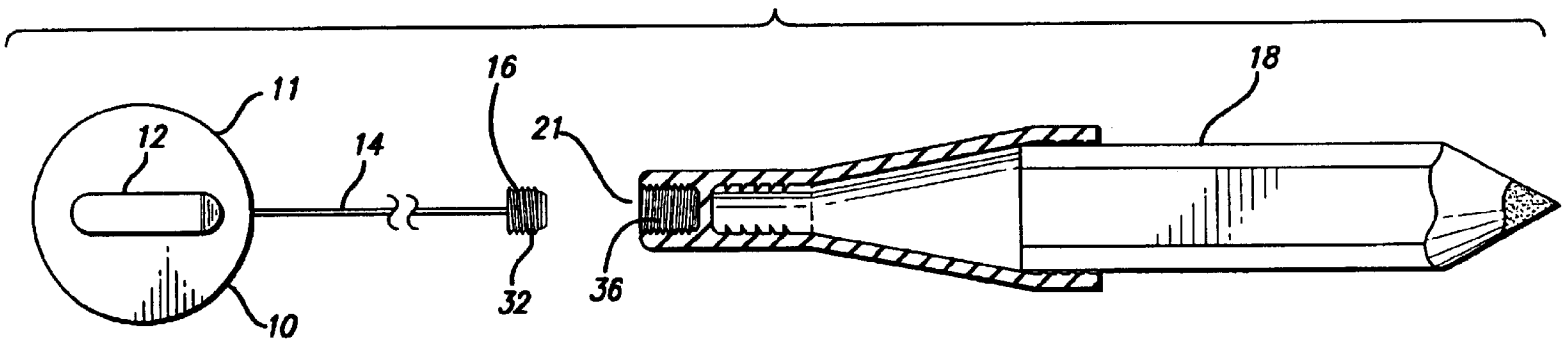
FIG. 6 is a cross-sectional side view of yet another exemplary embodiment.

As shown in FIG. 1, the flexible retaining adapter 17 has a generally funnel-shaped body. The adapter has a bore 21 that is sized to receive a plug 16. The bore 21 may have smooth inner walls in one exemplary embodiment. In another exemplary embodiment, the walls may have annular ridges 34 extending into the bore 21 as shown in FIG. 3. In yet another exemplary embodiment, the bore 21 may have threads along the inner walls of the bore 21 as shown in FIG. 6. The adapter 17 also includes a wall 24 that separates the bore 21 from the main cavity 22. The main cavity 22 has a cross-section that diminishes as it approaches the wall 24 that separates the cavity 22 from the bore 21. The decrease in diameter of the main cavity walls provides a universal adapter that is sized to engage a wide variety of writing, marking, or pointing instruments of different diameters to be securely held by a frictional fit.

The adapter 17 may be made of a plurality of materials that have the characteristic of being relatively stiff, yet slightly resilient. Exemplary materials include, but are not limited to, vinyl or rubber.

According to various exemplary embodiments, as shown in FIGS. 1–3, the inner walls of the main cavity 22 are generally smooth. In alternate embodiments, as shown in FIGS. 5 and 6, the inner walls of the main cavity 22 may be provided with annular ridges that extend away from the walls of the main cavity 22.

The adapter is capable of housing various instruments of different diameter sizes due to the resilient nature of the material and the varying diameters of the cavity 22. For instance, as shown in FIG. 1, the adapter 17 is capable of housing an instrument having a large diameter such as a carpenter's pencil 18. That is, these large diameter instruments are inserted into the mouth of the adapter 17 and the inner walls of the adapter engage the outer walls of the instruments. As shown in FIG. 2, the adapter 17 is capable of holding those instruments 19 having smaller diameter. That is, the inner walls of the cavity 22 that are near the inner wall 24 are capable of engaging the small diameter instrument. Furthermore, the adapter 17 is capable of engaging instruments having irregular cross-sections so long as the instruments are inserted into the cavity 22 to sufficiently form a tight frictional fit with the instrument. Additionally, the instrument may be removed from the cavity 22 with a sufficient pulling force to overcome the frictional fit and be replaced with another instrument.

In another exemplary embodiment, the retractor 11 includes a pencil-rod attachment 25. This attachment 25 is a generally elongated cylindrical structure. The attachment 25 is sized to be inserted in a bore 38 or a press-in clip bracket that is found on most hand-pulled or motorized golf carts. According to one exemplary embodiment, the attachment 25 has a diameter that is approximately the same diameter of a typical golf pencil. As those skilled in the art will appreciate, the diameter and/or length of the attachment 25 may be varied depending upon the intended application.

Figure 4:
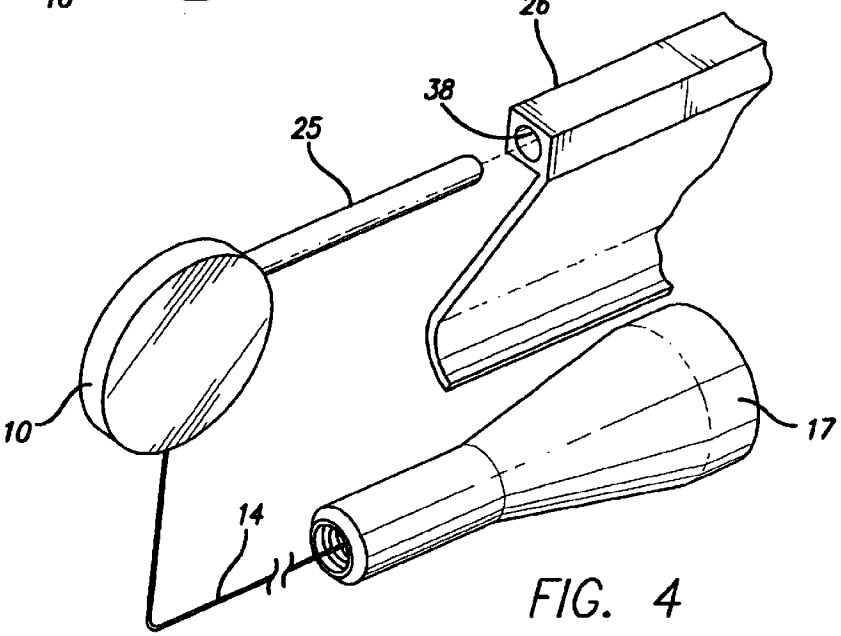
FIG. 4 is an exploded perspective view of an alternate exemplary embodiment.

As shown in FIG. 4, the attachment 25 would be inserted into the bore 38 that is found on a golf cart and the writing instrument such as a golf pencil (not shown) would be inserted into the mouth of the adapter. Accordingly, when the user wants to access or use the writing instrument, the user would grasp the writing instrument and be able to extend the writing instrument away from the retractor housing 10 and use the writing instrument. When finished, the user may release the writing instrument, and the instrument will be held in an easily accessible location to the user for future use.

While exemplary embodiments of the retractable instrument holder have been described with regards to various embodiments, it is recognized that additional variations of the retractable instrument holder may be devised without departing from the inventive concept.

What is claimed is:

1. A retractable device for retaining a writing instrument, comprising:

a retractor comprising a retractor body that houses a cable, the cable having a first end positioned within the retractor body and a second end positioned outside the retractor body, the cable having a protuberance coupled to the second end, and wherein the cable is selectively extendable from the retractor body and retractable into the retractor body; and an adapter coupled to the protuberance, the adapter comprising a main body having a first portion and a second portion, wherein the first portion and the second portion are separated by a partition; the first portion defining a first bore having a substantially constant diameter, and the second portion defining a second bore having a tapered inner bore.

2. The retractable device of claim 1 wherein the adaptor is coupled to the protuberance by an adhesive.

3. The retractable device of claim 1 wherein the adaptor is coupled to the protuberance by a friction fit.

4. The retractable device of claim 1 wherein the protuberance includes one or more annular ridges extending from an outer surface of the protuberance.

5. The retractable device of claim 1 wherein the protuberance is provided with threads that mate with walls of the first bore.

6. The protuberance of claim 1 wherein the protuberance is sized to engage the walls of the first bore.

7. The retractable device of claim 6 wherein the first bore is provided with at least one ridge projecting away from the walls of the first bore.

8. The retractable device of claim 1 wherein the second bore is provided with at least one ridge projecting away from the walls of the second bore.

9. The retractable device of claim 1 wherein the tapered inner bore of the second portion of the adapter is funnel-shaped.

10. The retractable device of claim 1 wherein the tapered inner bore of the second portion of the adapter is bottleneck-shaped.

11. The retractable device of claim 1 further comprising an elongated rod that is coupled to the retractor body, the elongate rod sized to engage a bore or a press-in clip bracket.

12. A retractable device for retaining a writing instrument, comprising:

a retractor comprising a retractor body that houses a cable that is selectively extendable from and retractable into the retractor body, and a protuberance provided at a first end of the cable; and an adapter comprising a main body having a first portion and a second portion, wherein the, first portion and the second portion are separated by an inner wall; the first portion defining a first bore having a substantially constant diameter wherein the first bore engages the protuberance, and the second portion defining a second bore having a funnel-shaped inner bore that is capable of engaging an outer wall of the writing instrument.

13. The retractable device of claim 12 further comprising a fastening means coupled to the retractor.

14. The retractable device of claim 13 wherein the fastening means is an elongated rod sized to engage a bore or a press-in clip bracket.

15. The retractable device of claim 12 wherein the protuberance includes one or more annular ridges extending from an outer surface of the protuberance.

16. The retractable device of claim 12 wherein the protuberance is provided with threads that mate with corresponding threads on walls of the first bore.

17. A retractable device for retaining a writing instrument, comprising:

a retractor comprising a retractor body coupled to a fastening means and the retractor body housing a cable, the cable having a first end positioned within the retractor body and a second end positioned outside the retractor body, the cable having a protuberance having annular ridges extending from an outer surface of the protuberance, wherein the protuberance is coupled to the second end, and wherein the cable is selectively extendable from the retractor body and retractable into the retractor body; and a flexible adapter comprising a main body having a first portion and a second portion, wherein the first portion and the second portion are separated by an inner wall; the first portion defining a first bore having a substantially constant diameter wherein the first bore engages the protuberance by a friction fit, and the second portion defining a second bore having a funnel-shaped inner bore that is capable of engaging and retaining the writing instrument.

18. The retractable device of claim 17 wherein the fastening means is a belt clip or a bulldog clip.

19. The retractable device of claim 17 wherein the fastening means is an elongated rod sized to engage a bore or a press-in clip bracket.

* * * * *